United States Patent [19]

Mourier

[11] 4,099,093

[45] Jul. 4, 1978

[54] ELECTRONIC TUBE FOR GENERATING MILLIMETRIC WAVE PULSES

[75] Inventor: Georges Mourier, Paris, France

[73] Assignee: Thomson-CSF, Paris, France

[21] Appl. No.: 693,861

[22] Filed: Jun. 8, 1976

[30] Foreign Application Priority Data

Jun. 13, 1975 [FR] France ..... 75 18545

[51] Int. Cl.[2] ..... H01J 25/34

[52] U.S. Cl. ..... 315/39.3; 315/39.51; 315/39.77

[58] Field of Search ..... 315/39.3, 39.77, 39.51, 315/39.53

[56] References Cited

U.S. PATENT DOCUMENTS

| | | | |
|---|---|---|---|
| 2,420,342 | 5/1947 | Samuel | 313/341 X |
| 2,715,697 | 8/1955 | Webber | 315/39.77 X |
| 3,069,594 | 12/1962 | Feinstein | 315/39.3 |
| 3,158,779 | 11/1964 | Ayaki | 315/393 |
| 3,223,882 | 12/1965 | Thal, Jr. | 315/39.3 |
| 3,273,011 | 9/1966 | Brown | 315/39.3 X |

FOREIGN PATENT DOCUMENTS

| | | | |
|---|---|---|---|
| 750,021 | 6/1956 | United Kingdom | 315/39.77 |

*Primary Examiner*—Saxfield Chatmon, Jr.
*Attorney, Agent, or Firm*—Roland Plottel

[57] ABSTRACT

A millimetric wave tube for generating high energy pulses, comprising, in particular, a slotted cylindrical anode carrying resonant cavities, and means for creating an electron cloud rotating about the axis of the anode, and performing the function of a negative electrode. An energy exchange takes place from the electron cloud to a millimetric wave which develops in the resonant cavities, so that the millimetric wave is amplified.

5 Claims, 6 Drawing Figures

ELECTRONIC TUBE FOR GENERATING MILLIMETRIC WAVE PULSES

The present invention relates to the field of millimetric waves and, more particularly, to an electronic tube for the generation of high-energy pulses.

An electronic tube for generating millimetric waves, involving an exchange of energy for amplification purposes, between a millimetric wave and an electron beam, is conventionally constituted by an electron-emitting cathode, an anode accelerating and possibly collecting the electrons, and a structure whose function is to guide and delay the millimetric wave in order to allow the interaction to take place between electrons and the millimetric wave, which interaction amplifies the wave.

It will be recalled, by way of example, that a magnetron is constituted by the following:

1. a cylindrical cathode and a cylindrical anode in a coaxial arrangement, which are positioned in a direct axial magnetic field;

2. a delay line through which the millimetric wave propagates and which can be constituted by resonant cavities carried by the anode;

3. coupling means that enable the microwave energy to be picked off.

In this structure and also for suitable values of the electric field and the magnetic field, the electrons are directed toward the anode along a trajectory that is not radial, owing to the presence of the magnetic field. During this motion, the electrons supply energy to the millemetric wave oscillating in the cavities.

The kind of electronic tube in question is limited in performance toward the high-power and high-frequency end, in particular owing to the electric arcing that can develop between cathode and anode when the interelectrode electric field is high.

The object of the present invention is an electronic tube that makes it possible, by using simple means, to produce high-energy, pulsed millimetric waves.

According to the invention, there is provided an electronic tube for generating millimetric wave pulses, comprising: an evacuated enclosure, part of which is substantially cylindrical, said cylindrical part having an axis, and slotted over the whole of its length, said enclosure furthermore comprising a first plate and a second plate, arranged at each end of said slot and opposite one another; electronemissive means located outside said cylinder; means for guiding said electrons towards said cylinder and for rotating said electrons in said cylinder, comprising means for supplying a current flowing transversely through said enclosure, that is to say, successively through said first plate, said cylinder and said second plate, thus creating an electric field as well as a magnetic field, said fields guiding said electrons toward said cylinder and imparting to them a cycloidal motion about said cylinder axis; resonant circuits in which a millimetric wave is capable of oscillating, arranged and designed so that the electrons supply energy to the millimetric wave while rotating in said cylinder; and means for picking off the millimetric wave energy.

For a better understanding of the invention and a demonstration of how it may be carried into effect, reference will be made to the following description and the attached figures:

FIGS. 1, 2, and 3 are diagrams illustrating means for creating an electron cloud in the tube in accordance with the invention;

Figure 6:
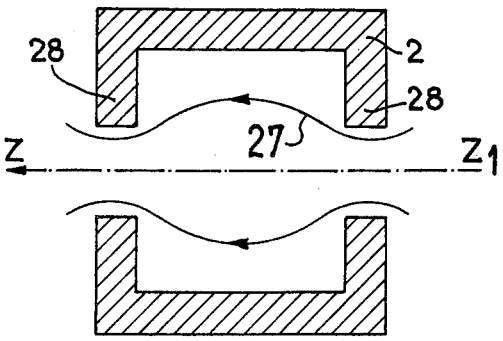

FIG. 6 schematically illustrates an improvement to the tube in accordance with the invention.

In these various Figures, similar elements have been indicated by similar references.

Figure 1:
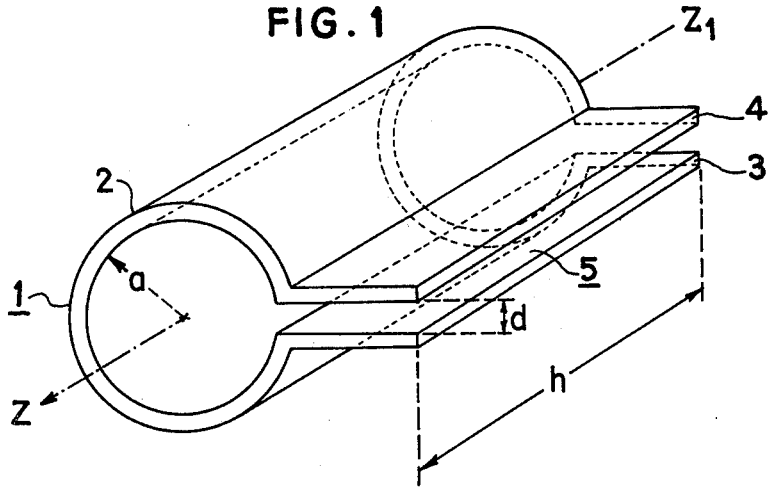

FIG. 1 illustrates a cylinder 2, of axis $Z_1Z$, made of an electrically conductive material and slotted over its whole length along the axis $Z_1Z$. The cylinder 2 is equipped at either side of the slot with conductive plates 3 and 4, which are mutually parallel and, therefore, form a capacitor marked 5, the cylinder 2 itself forming an inductor. The cylinder 2 and the plates 3 and 4 are generally marked 1.

Figure 2:
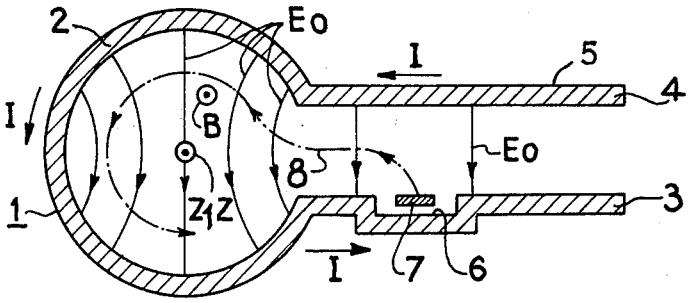

FIG. 2 illustrates the element 1 in section, perpendicularly to the axis $Z_1Z$ of the cylinder 2. The plate 3 is, moreover, equipped with a groove 6, in which a cathode 7 is arranged, the latter being designed to emit electrons when heated; it is for example, constituted by a strip of electron-emissive material arranged longitudinally in the groove 6, without electrical contact with the plate 3.

When an electric current I flows through the element 1 transversally, that is to say in the plane of section, there is created an electric field $E_o$ between the plates 3 and 4 in the cylinder 2, and a magnetic field B directed along the axis $Z_1Z$ of the cylinder 2, the lines of force having been illustrated in the figure according to the illustrated current I. These fields $E_o$ and B are constant as long as the current is.

When the cathode 7 is heated, it emits electrons. Their normal trajectory toward the plate 4 is deflected by the field B toward the interior of the cylinder 2, along a general trajectory 8 represented in the FIG. 2 in broken line.

Figure 3:
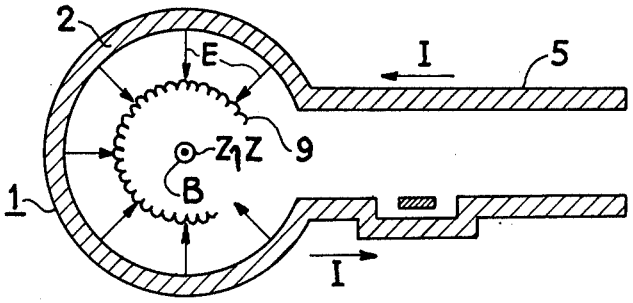

If the electron stream thus filling the cylinder 2 is sufficient, then the electrons induce a second electric field marked E, shown in FIG. 3 which illustrates the same section as FIG. 2. Said field E is radially directed. As those skilled in the art will appreciate, the simultaneous action on the electrons, of the fields B and E, which are mutually perpendicular, produces in the latter a cycloidal motion marked 9 in FIG. 3, resulting from the superimposition of (1) the circular motion created by the magnetic field B in a plane normal thereto, said motion being of radium very much less than that of the cylinder if the field B is strong enough, and (2) a motion of transfer along a trajectory normal to B and E, that is to say circular about $Z_1Z$, the radius of which is of the same order of magnitude as that of the cylinder 2 although less than the latter.

A device of the kind described hereinbefore, therefore, makes it possible, when it carries a current I, to fill the cylinder 2 with a cloud of electrons rotating about the axis $Z_1Z$ of the cylinder and theoretically in stable motion. It should be noted that the orbits of the electrons depend, in particular, upon their instant of emission, the first being the closest to the center, so that, through a variation in the current I with time, it is possible to achieve a uniform space charge.

This device makes it possible in the tube in accordance with the invention to avoid the need for a negative central electrode, as shown hereinafter.

The electric current (I) flowing in conductor 1 along flange portions 3 and 4 (FIG. 2) generates a magnetic field whose relation with the repulsion force between electrons may be examined as follows.

Since the magnetic force $\vec{F_B}$ generated on an electron by a magnetic field $\vec{B}$ is function of the electron velocity $(\vec{v})$ : $\vec{F_B} = q\vec{v} \times \vec{B}$, a possible problem of insufficiency only arises when the electrons are injected, i.e., between flanges 3 and 4.

In other words, the device works if an electron emitted from the cathode 7 does not reach the flange 5 but follows the path 8 on FIG. 2.

In the device according to the invention, which is a pulsed device, the injection of electrons is realized while the electrical current (I) grows up.

It is well known that an electron in a magnetic field $\vec{B}$ has a circular movement around it (Larmor phenomenon), which is characterized by the following equation:

$$W_c \cdot R = \sqrt{2e/m\ V}$$

where $W_c$ is the cyclotronic pulsation of the electron $R$ is the Larmor radius $e$ and $m$ are the charge and the mass of the electron and $V$ is the potential difference between the flanges 3 and 4. Since $W_c = e/m\ B$, we have:

$$B \cdot R = \sqrt{2 \cdot m/e \cdot V}$$

If $d$ is the distance between the flanges 3 and 4, we have the following condition, for an electron from the cathode 7 not to reach the flange 5:

$$\boxed{Bd \geqq \sqrt{2 \cdot \frac{m}{e} \cdot V}}$$

since B is a function of I and V is a function of dI/dt, it is apparent that the condition is satisfied if the current I is growing slowly enough.

This result is well known in plasma techniques.

The equation $B_c d = \sqrt{2m/e \cdot V}$ defines a critical value ($B_c$) for the magnetic field B, and where, keeping the same notations as before (and with reference to FIG. 1):

$e$ and $m$ are the charge and the mass of an electron $V$ is the potential difference between the flanges 3 and 4 ($V = E_o \cdot d$).

Let us calculate $$B_o = \frac{\sqrt{\frac{2m}{e} \cdot V}}{d},$$

that is to say $$B_c = 3.36 \sqrt{V/d}$$

(1) if:

$B$ is in Gauss $V$ is in volts $d$ is in centimeters.

The potential V is given by:

$$V = L_o \cdot dI/dt$$

(2) with:

$$L_o = \text{self of the cylinder } 1 = \mu_o \cdot \pi d^2/h$$

$$(dI/dt) = I/\tau$$

where:

$\tau$: the time during which the current I exists $I = h.H$

H : magnetic H:magnetic field $= B/\mu_o$

The following values were tested:

| | | |
|---|---|---|
| a = 0.25 cm<br>h = 0,5 cm | → | $L_o = 5.20^{-9}$ Henry |
| B = $20.10^3$ Gauss | → | H = $3.20^6$ Ampere/metre<br>I = $15.10^3$ Ampere |
| $\tau = 20.10^{-9}$ sec. | → | V = $4.10^3$ volts (from (2) ) |
| d = 0,05 cm | → | $B_c$ = 4250 Gauss (from (1) ) |

It is well known that a suitable value for $B$ is $B = 4 \cdot B_c$, since v (velocity of the electrons) is in the order of twice $E/B$.

So with the values given here for B and $B_c$, the ratio $B/B_c$ is near 4,7, which is quite sufficient for a satisfactory working.

Figure 4:
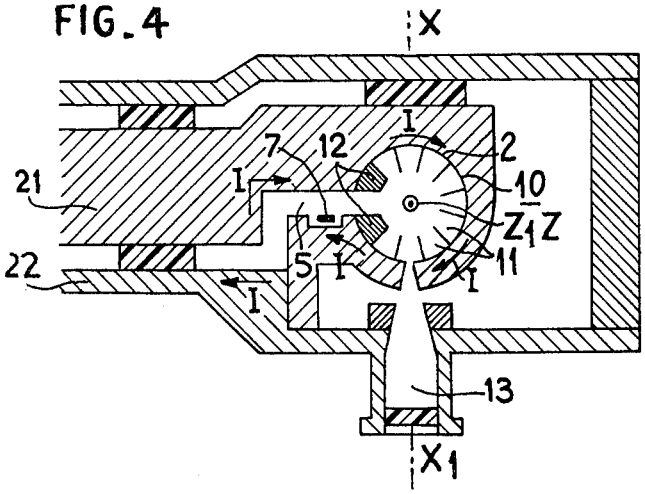
FIG. 4 illustrates an embodiment of the tube in accordance with the invention.

FIG. 4 is a transverse sectional view of a first embodiment of the electronic tube in accordance with the invention.

The tube marked overall by the reference 10 is constituted by the cylinder 2 of axis $Z_1Z$, which is slotted and provided with mutually opposite conductive surfaces forming the capacitor 5. One of these surfaces carries the cathode 7, which is connected to an external voltage source (not shown) for heating purposes. The cylinder 2 incorporates a resonant circuit constituted in the example of the Figure by resonant cavities 11. At either side of the capacitive slot 5, elements 12 are arranged and designed to terminate the resonant microwave circuit 11 in an appropriate impedance, depending upon the mode of operation of the tube, that is to say, in a short-circuit for operation as a fixed-frequency oscillator or in the characteristic impedance of the circuit for operation as a carcinotron.

Finally, the conductive surfaces of the capacitor 5 are connected to a current supply in such a fashion that the current I can flow transversely (that is to say, in the plane of the Figure) and successively through one of the surfaces of the capacitor. In the embodiment shown in FIG. 4, the supply is coaxial; it comprises an internal conductor 21 and an external conductor 22, the direction of the current I being chosen for example in such a way that it creates a magnetic field B orientated along the axis $Z_1Z$.

The operation of this device, as far as the means for generating and guiding the electrons are concerned, is in accordance with what has been described earlier.

The supply of the current I through the coaxial input conductor, transversely through the tube 10, induces a magnetic field B directed along $Z_1Z$ and an electric field $E_O$ (as shown in FIG. 2), which enable the stream of electrons emitted by the cathode 7 to be guided towards the cylinder 2. The space charge constituted by the electrons in the cylinder 2 induces a radial electric field E (shown in FIG. 3), of substantially constant strength.

The action of the fields E and B causes the above mentioned electron cloud to rotate. In addition, high-frequency oscillations establish in the cavities 11 when the rate of rotation of the electron cloud reaches the phase velocity of the wave defined by the characteristics of the resonant circuit.

The exchange of energy from the electrons to the high-frequency wave takes place substantially in the same way as in a conventional traveling wave multicavity magnetron, in which the magnetic field B is no longer supplied by an external magnet but by the current I, and the electric field E is no longer established by potential difference between two concentric electrodes, anode and cathode, but by the space charge developed by the electrons, which thus replace the negative central electrode, the anode now being constituted by the cylinder 2.

The millimetric wave thus generated is picked off at an output 13 connected to one of the cavities 11.

The mode of operation described hereinbefore theoretically exists as long as the current I exists, but the electrons giving up their energy to the millimetric wave ultimately return to the anode. It is, therefore, necessary to replenish periodically the electron cloud in the cylinder 2, and the wave produced is necessarily of pulse type.

In the foregoing, operation on the lines of a magnetron has been described but, it goes without saying, the structure described; could be adapted to other types of operation of a kind known per se, employing interactions between millimetric waves and electrons, in particular operation of the carcinotron type.

In addition, those skilled in the art will appreciate that in high-power tubes, the power is often limited by the arcing or breakdown occurring between anode and cathode under the effect of high electric fields. By contrast, the tube in accordance with the invention, owing to the absence of any negative electrode, makes it possible to employ very high fields at the internal surface of the cylinder, fields reaching as much as $10^6$ volts/cm, by the use of a high electron density and a high pulse magnetic field.

Finally, the device, in accordance with the invention, is extremely simple in mechanical terms and moreover, needs only a heating voltage for the cathode 7.

Figure 5:
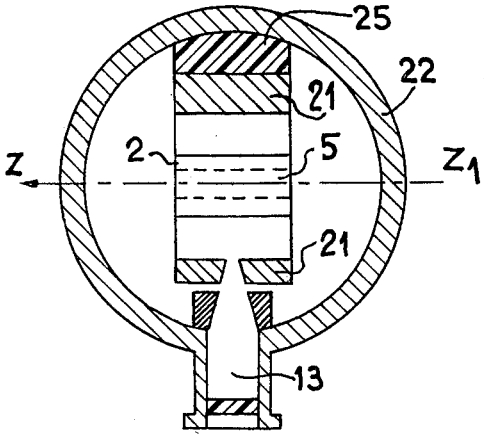
FIG. 5 is a sectional view of the tube shown in FIG. 4.

FIG. 5 is a sectional view of the device shown in FIG. 4, on the axis $XX_1$. There we can see the external conductor 22, an insulator 25 between the latter and the top part of the internal conductor 21, the cylinder 2 and the output 13. Also shown are the axis $Z_1Z$ and the capacitive slot 5.

FIG. 6 schematically illustrates an improvement to the tube in accordance with the invention. In this Figure, only the cylinder 2 has been shown, the view being a sectional one in a plane containing the axis $Z_1Z$. In accordance with this variant embodiment, the ends of the cylinder are closed off by rings 28 in order to modify the configuration of the magnetic field, creating a radial component. The lines of force obtained, shown in this Figure (27), make it possible to improve the focusing of the electron cloud along the axis $Z_1Z$.

The tube, in accordance with the invention, is applicable, for example, to the production of medium power transmitters, producing some few kilowatts during pulses of the order of $10^{-9}$ seconds.

What is claimed is:

1. An electronic tube for generating millimetric wave pulses, comprising:

an evacuated enclosure, part of which is substantially cylindrical, said cylindrical part having an axis, and being slotted over the whole of its length, said enclosure furthermore comprising a first and a second plates, arranged at each side of said slot and opposite one another;

electron emissive means located outside said cylinder;

means for guiding said electrons towards said cylinder and for rotating said electrons in said cylinder, including means for supplying a current flowing transversely through said cylinder, successively through said first plate, said cylinder and said second plate, thus creating an electric field as well as a magnetic field, said fields guiding said electrons towards said cylinder and imparting to them a cycloidal motion about said cylinder axis;

resonant circuit means in which a millimetric wave is capable of oscillating, arranged and designed so that the electrons supply energy to the millimetric wave whilst rotating in said cylinder; and means for picking off the millimetric wave energy.

2. A tube according to claim 1, wherein said electron-emissive means comprise a strip of electron-emissive material arranged longitudinally on one of said plates but without electrical contact therewith.

3. A tube according to claim 1, wherein said resonant circuit means comprises resonant cavities carried by said cylinder.

4. A tube according to claim 1, wherein said supplying means comprises a coaxial input, and said cylinder being in electrical contact with an internal conductor of said coaxial input through said plates, said current thus flowing transversely through said enclosure.

5. A tube according to claim 1, wherein said cylinder is closed at its ends by two rings, thus accentuating the longitudinal focusing of the electrons in the cylinder.

* * * * *